United States Patent [19]

Main

[11] 4,016,615

[45] Apr. 12, 1977

[54] CANOE PORTAGING KIT

[76] Inventor: Glen A. Main, 9699 Esplanade, Windsor, Ontario, Canada, N8R 1J7

[22] Filed: Nov. 3, 1975

[21] Appl. No.: 628,140

[52] U.S. Cl. ..... 9/1.4; 16/115; 224/25 A

[51] Int. Cl.[2] ..... A45F 3/15

[58] Field of Search ..... 9/1 D, 1 R, 1 K, 1 C; 224/25 A, 42.11; 16/114 R, 115

[56] References Cited

UNITED STATES PATENTS

| | | | |
|---|---|---|---|
| 1,257,073 | 2/1918 | Frank | 9/1 R |
| 1,549,514 | 8/1925 | Smith | 16/115 X |
| 2,671,231 | 3/1954 | Massicotte | 9/1 C |
| 3,375,960 | 4/1968 | Stevens et al. | 224/42.11 |
| 3,436,778 | 4/1969 | Stevens et al. | 9/1 C X |
| 3,734,367 | 5/1973 | Jackson | 224/25 A |

*Primary Examiner*—Trygve M. Blix
*Assistant Examiner*—Gregory W. O'Connor
*Attorney, Agent, or Firm*—Charles Krassov

[57] ABSTRACT

This invention consists of a kit for facilitating the portage of canoes. The kit contains two identical spring loaded telescopic rods which attach spaced and parallel to each other to and between the central bar of the canoe and and any other strut on either side of said central bar, or to the front edge of the rear or front seat of the canoe. The other part of the kit consists of a cushion of soft resilient material which attaches to the center bar of the canoe and which is contoured to fit comfortably the back of the neck and center between the shoulders of the person carrying the canoe.

2 Claims, 6 Drawing Figures

CANOE PORTAGING KIT

This invention consists of a kit of items used to facilitate the portaging of canoes.

In travel or transportation by water routes, particularly through uninhabited areas, national parks, or general wooded areas where modern roads do not exist, travelers such as hunters, explorers, naturalists, and such, often resort to the use of the canoe. In wild country travel by water such as small rivers and lakes, one often finds various obstruction along the route in which case the canoe has to be taken out of the water and carried overland until the water route can be resumed again. The carrying of the canoe is usually referred to portage, and it consists of turning the boat upside down and carrying it upon the shoulders in a somewhat balanced position, with the head of the carrier partly within the upturned canoe.

One of the main reasons why canoes are chosen for such travel is the lightness of this craft. However, carrying even a comparatively light craft in an overhead position, over rough terrain, and for an extensive period of time, can become very fatiguing and at times painful, requiring frequent rest stops, and generally slowing down the pace of the expedition.

The object of this invention is to provide means for portaging a canoe in a more comfortable manner than the method used at the present time.

This is accomplished in the invention by providing means for better gripping and holding the canoe, and by providing cushioning between the canoe and the neck and shoulders of the carrier.

Figure 1:
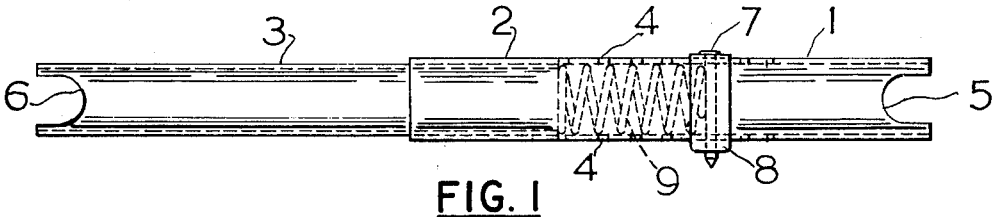
Figure 3:
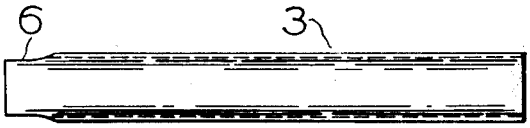
Figure 2:
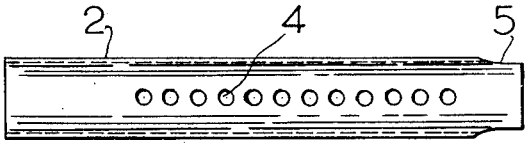
Figure 5:
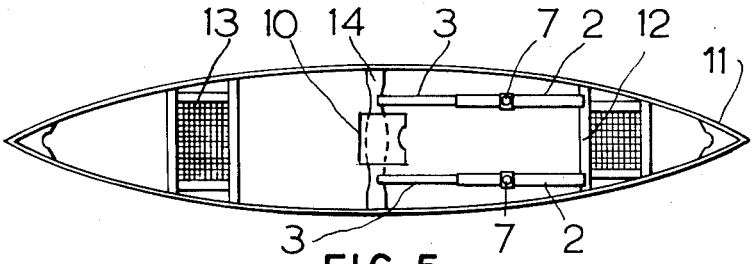
Figure 4:
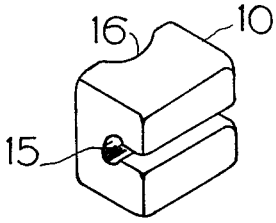
Figure 6:
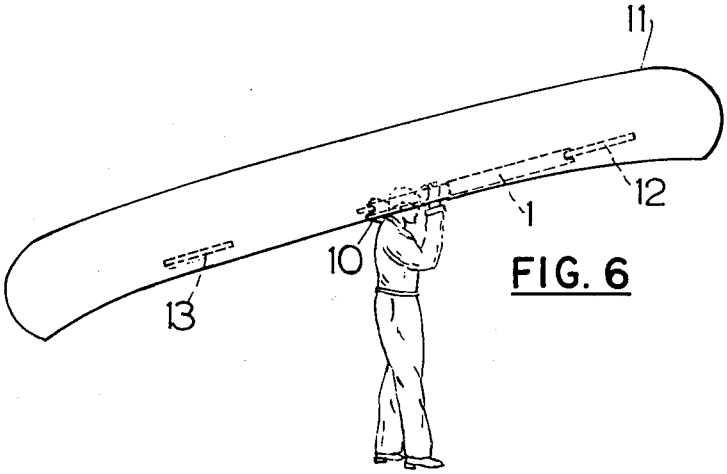

In describing the invention reference will be made to the attached drawings in which, FIG. 1 is a side view of one item of the kit comprising the invention, FIG. 2 is a top or bottom view of one of the components of the item in FIG. 1, FIG. 3 shows a similar view of another component of the item in FIG. 1, FIG. 4 shows an isometric view of another item of the kit comprising the invention, FIG. 5 shows a plan of a canoe with the invention installed therein, and FIG. 6 shows the manner of portaging a canoe equipped with the invention.

The kit which constitutes the invention consists of a pair of telescopic carrying rods 1 which are added to the structure of the canoe, and by means of which the canoe is held during portaging. The rod 1 is made up of an outer tube 2 and an inner tube 3 which slidably fits into the tube 2. The outer end of the tube 2 is notched as shown by 5, and the inner tube 3 is similarly notched on its outer end as shown by 6. The outer tube is provided with a plurality of spaced holes 4, so that a pin 7 can be pushed through two opposite holes to form a stop for a spring 9. The tube 3 is inserted on top of the spring 9, as shown in FIG. 1.

To attach a pair of carrying rods 1 to the canoe 11, the required length of the rod 1 is at first established by inserting the pin 7 through a pair of opposite holes so that it will give a length to the rod 1 somewhat larger than the distance between the centre bar 14 and the front edge of the seat 12 of the canoe; the rods are then compressed, inserted between 14 and 12, then allowed to expand so that the notches 5, 5, are fitted onto the edge of the rear seat, while the notches 6, 6 are fitted into the edge of the central canoe bar 14. The bars *i*, *i*, are now held firmly in position as shown in FIG. 5, by the pressure of the compressed springs 9, 9.

A cushion 10 made of sponge rubber or any other soft plastic material is preferably made of a shape to conform with the back of the neck and part of the shoulders of the carrier, as shown diagrammatically at 16. A groove 15 is provided in the cushion by means of which it can be slipped onto the central bar 14, and held thereby during the portaging operation.

The pin 7, is of existing standard design consisting of an open circular section of flat spring steel 8. The pin 7 is attached on the inside of the spring 8 at its bottom and extends beyond 8 through its opening. The pin 7 is inserted into any pair of holes 4 depending upon the required free length of the rod 1, and the circular spring 8 holds the pin from falling out of the hole, by clamping the pin to the wall of the tube.

The method of carrying the canoe is illustrated in FIG. 6. The person carrying the canoe above his head, holds the canoe by the rods 1, 1, one in each hand, while the cushioned central bar 14 rests upon the back of the neck and the part between the shoulders.

Having described the invention, what I claim is:

1. A kit for facilitating the portaging of canoes, comprising a pair of identical, spring loaded, telescoping carrying rods, one end of each being removably attached to the center bar of the canoe, while the other end of each is similarly attached to the front edge of the rear seat of the canoe or to an independent strut spaced from and on either side of said center bar; each of said rods consisting of a rigid outer tube of metal or plastic; an inner tube of such material which fits slidably into said outer tube; two opposite rows of identically spaced and located holes in the wall of said outer tube for inserting a pin through said outer tube; a short spring located within said outer tube, one end of which rests upon said pin while the other end is in contact with the enclosed end of the inner tube; and a pair of identical notches, each notch located in the outer end of both said tubes, said notches being wide enough to contain therein the center bar, the front edge of the rear seat of the canoe, or the independent strut on either side of the center bar; and a cushion of soft material which is slipped over said center bar to provide comfort to the person carrying the canoe.

2. A kit such as described in claim 1 in which said cushion consists of a block of cut or moulded resilient and soft material, contoured to fit the back of the neck and part of the shoulders of the person carrying the canoe, and said cushion being provided with a groove by means of which it can be be slipped over the said center bar of the canoe, and removably held therein.

* * * * *